US008112842B2

(12) United States Patent
Courtney

(10) Patent No.: US 8,112,842 B2
(45) Date of Patent: Feb. 14, 2012

(54) CLEANING APPLIANCE

(75) Inventor: Stephen Benjamin Courtney, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 744 days.

(21) Appl. No.: 12/250,426

(22) Filed: Oct. 13, 2008

(65) Prior Publication Data

US 2009/0106932 A1 Apr. 30, 2009

(30) Foreign Application Priority Data

Oct. 25, 2007 (GB) ..... 0720971.1

(51) Int. Cl.
*A47L 9/14* (2006.01)

(52) U.S. Cl. ..... 15/412; 15/327.2; 15/347; 15/352

(58) Field of Classification Search ..... 15/327.2, 15/412, 347, 352, 353; *A47L 9/14, 9/16*
See application file for complete search history.

(56) References Cited

U.S. PATENT DOCUMENTS 4,902,306 A 2/1990 Burnett et al.

FOREIGN PATENT DOCUMENTS

| | | |
|---|---|---|
| DE | 20321328 | 10/2006 |
| EP | 0042723 | 12/1981 |
| EP | 1321087 | 6/2003 |
| EP | 1535562 | 6/2005 |
| GB | 2320419 | 6/1998 |
| GB | 2 349 105 | 10/2000 |
| GB | 2349105 | 10/2000 |
| JP | 2002-355198 | 12/2002 |
| JP | 2003-135332 | 5/2003 |
| JP | 2003-529404 | 10/2003 |
| JP | 2006-297134 | 11/2006 |
| KR | 2001-027470 | 4/2001 |
| WO | WO-01/45545 | 6/2001 |

OTHER PUBLICATIONS

British Search Report completed on Jan. 31, 2008 directed towards counterpart foreign application No. GB0720971; 1 page.

International Search Report and Written Opinion mailed on May 7, 2009 directed to related application No. PCT/GB2008/003530; 12 pages.

*Primary Examiner* — David Redding

(74) *Attorney, Agent, or Firm* — Morrison & Foerster LLP

(57) ABSTRACT

A cleaning appliance includes a main body, including a motor and fan unit for generating an airflow, a separating apparatus for separating dirt and dust from the airflow and a passageway for receiving a filter. The passageway and a filter may be located downstream of the separating apparatus and upstream of the motor, and the filter may have an at least partially curved filter surface. The filter is arranged around at least a part of the motor and fan unit. The filter is removable through a side, and through a wheel, of the appliance. The arrangement facilitates ease of removal of the filter from the cleaning appliance.

9 Claims, 5 Drawing Sheets

CLEANING APPLIANCE

REFERENCE TO RELATED APPLICATIONS

This application claims the priority of United Kingdom Application No. 0720971.1, filed Oct. 25, 2007, the contents of which are incorporated herein by reference.

FIELD OF THE INVENTION

The invention relates to a cleaning appliance, such as a vacuum cleaner.

BACKGROUND OF THE INVENTION

Vacuum cleaners are designed to separate dirt and dust from an airflow. Commonly, a motor and fan unit generates an airflow which draws dirt- and dust-laden air into the vacuum cleaner through a dirty air inlet. The airflow then passes through a form of separating apparatus such as a porous bag or a cyclonic separator (see, for example, EP 0 042 723) to remove dirt and dust from the airflow.

Irrespective of the type of separating apparatus used, there may be a risk of a small amount of dirt and dust passing through the separating apparatus and being carried to the motor and fan unit. It is undesirable for dirt and dust particles to pass through the fan of a motor and fan unit because the fan may become damaged or may operate less efficiently. In order to reduce this problem, some vacuum cleaners include a fine filter in an airflow path between the separating apparatus and the airflow generator (see, for example, GB 2 320 419). This filter is commonly known as a pre-motor filter and is used to extract any fine dirt and dust particles remaining in the airflow after it has passed through the separating apparatus.

It is also known to provide a filter in an airflow path downstream of the airflow generator in order to extract any remaining dirt and dust particles prior to the airflow exiting the appliance. This type of filter is known as a post-motor filter. The post-motor filter also captures particles produced by the brushes of the motor. The post-motor filter may be of the High Efficiency Particulate Air (HEPA) type, to remove very small particles from the airflow, such as smoke and allergens.

Filter assemblies for removing dust or debris from the air stream of a vacuum cleaner or other dust retaining appliances are therefore common. Such filter assemblies generally comprise at least one filter located in a filter housing.

During normal operation of a vacuum cleaner, dirt and dust may be deposited on a filter and, after a period of time, it could become blocked. Blockages reduce the efficiency at which a vacuum cleaner operates. Therefore, a typical filter will occasionally need to be replaced or cleaned in order to maintain the performance of the vacuum cleaner. In order to allow cleaning or replacement of the filter, it is common for such filters to be removable from a vacuum cleaner. Appliances with replaceable filters are common but the purchase of replacement filters can add to the overall cost of maintenance of the appliance.

Re-useable filters can reduce filter maintenance costs. U.S. Pat. No. 4,902,306, for example, discloses an air filter assembly including electrostatic filter elements and a foam filter that can be cleaned by washing.

Another type of known filter assembly is that used on the Dyson range of vacuum cleaners, for example, on model numbers DC04, DC07, DC12, DC14 and DC15. In these vacuum cleaners, the filter assembly essentially comprises a filter housing or filter cage, a first filter portion and a second filter portion. The filter housing has a round or rectangular cross-section and is manufactured from a suitable plastics material. The filter housing is adapted to receive the first and second filter portions. The second filter portion may be bonded to the filter housing to prevent misalignment. The first filter portion is usually washable. The second filter may also be washable and the second filter portion and the filter housing must be washed together if the second filter portion is bonded to the filter housing. After washing and after drying the filter assembly can be returned to the vacuum cleaner for further use.

The principle by which filter assemblies of this type operate is described in GB 2349105 and EP 1239760B.

SUMMARY OF THE INVENTION

According to the invention, there is provided a cleaning appliance comprising a main body, the main body including a motor and fan unit for generating an airflow, separating apparatus for separating dirt and dust from the airflow and a filter arranged around at least a part of the motor and fan unit, wherein the filter is removable through a side of the appliance.

The advantage of providing a removable filter accessible through a side of the appliance is that the user can more easily see where and how to access the filter, so the user is able to carry out servicing and maintenance procedures more quickly and easily. This also means that a filter requiring cleaning or replacement will be more readily dealt with, thus avoiding unnecessary strain or overloading on the filter which could, in turn, lead to dirt and dust passing through the filter and, in the case of a pre-motor filter, passing onto the motor and fan unit, leading to damage to motor and fan components.

Preferably, the filter is accessed through a hinged door in the appliance, the door including a wheel. The door may be the wheel itself. A catch may be provided for the door.

Preferably the filter is cylindrical and the motor and fan unit is located within the filter. This provides for a particularly compact configuration, allowing smaller, more compact appliances to be manufactured.

Preferably the filter surface extends around a portion or the cylindrical filter, preferably fully around the filter. This arrangement enables the maximum surface area of the filter material to be used, increasing a filter capacity and thus reducing the number of times the filter has to be cleaned.

In a preferred embodiment, the passageway for receiving the filter forms a scroll inlet, which provides for an incoming dirt and dust load to be spread evenly across a filter. An even spread of dirt and dust load helps to reduce localised blocking of the filter. The passageway comprises a wall and, preferably, the cross-sectional area of the passageway between the wall and the filter surface decreases in the downstream direction. An advantage of this arrangement is that the dirt and dust load is directed and channelled towards the filter medium.

Further advantageous features are set out in the detailed description below.

BRIEF DESCRIPTION OF THE DRAWINGS

Embodiments of the invention will now be described with reference to the accompanying drawings in which.

DETAILED DESCRIPTION OF THE INVENTION

Figure 1:
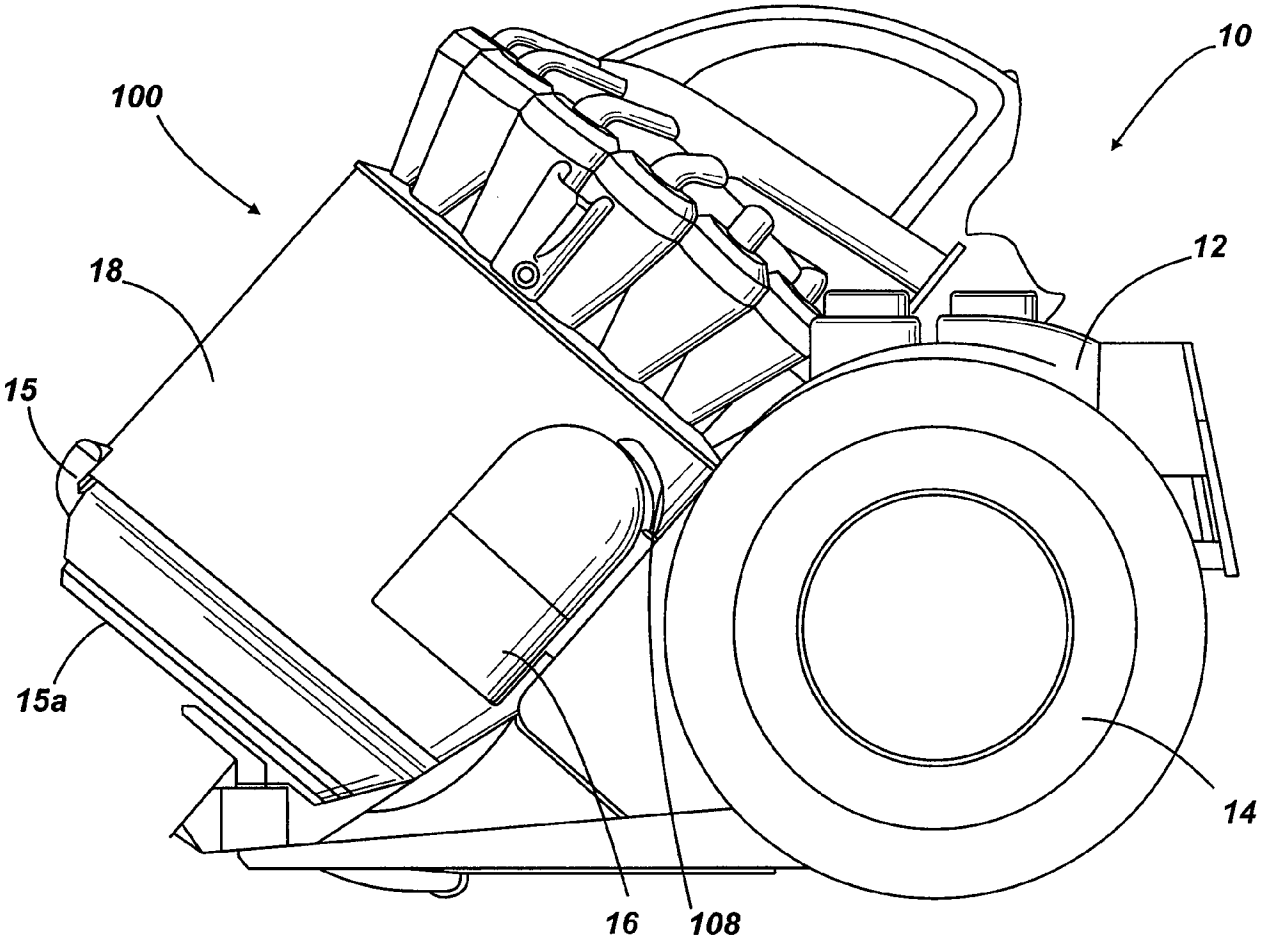
FIG. 1 is a side view of a cylinder vacuum cleaner constructed according to the invention.
Figure 2:
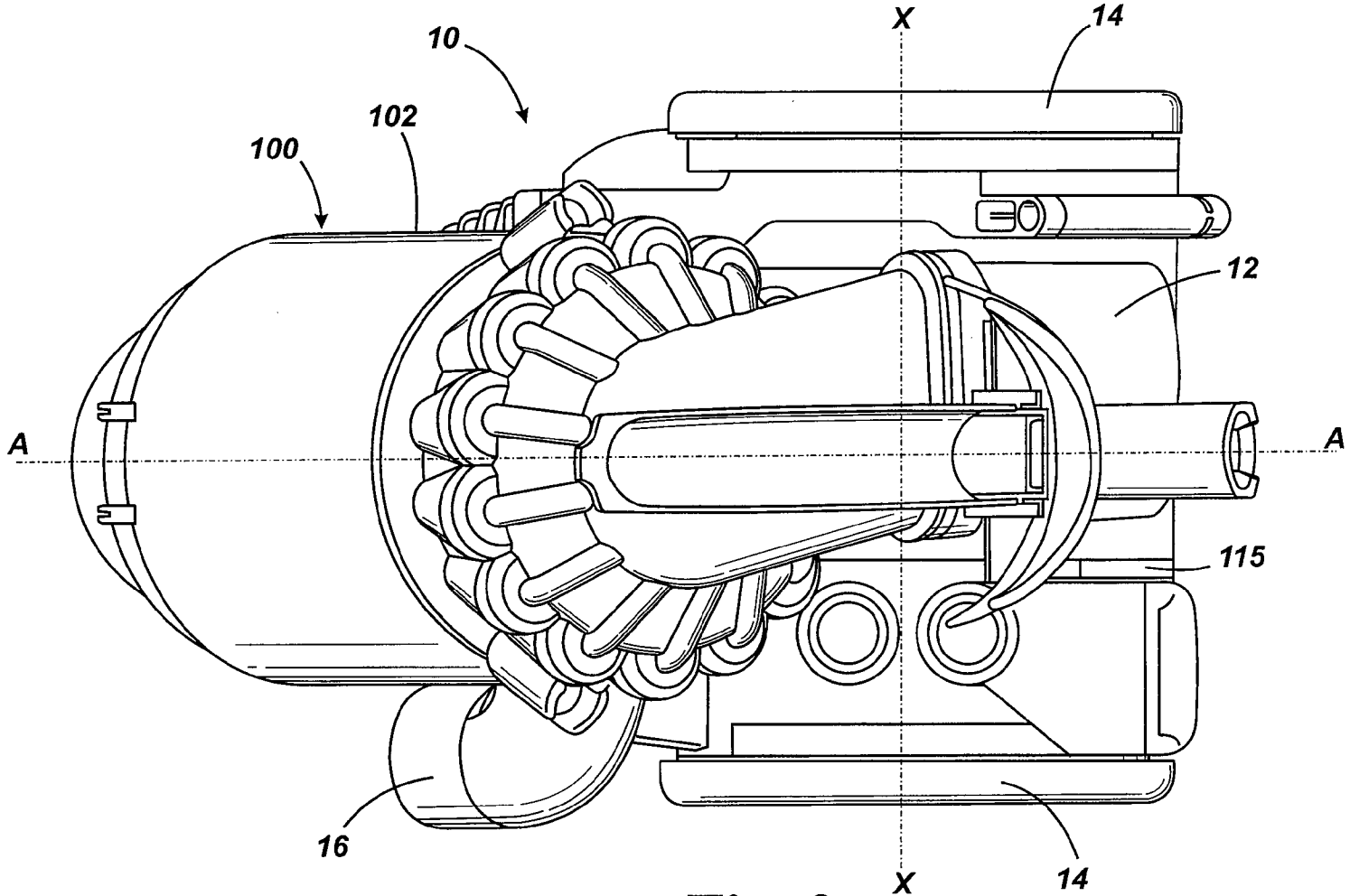
FIG. 2 is a plan view of the cylinder vacuum cleaner of FIG. 1.
Figure 3:
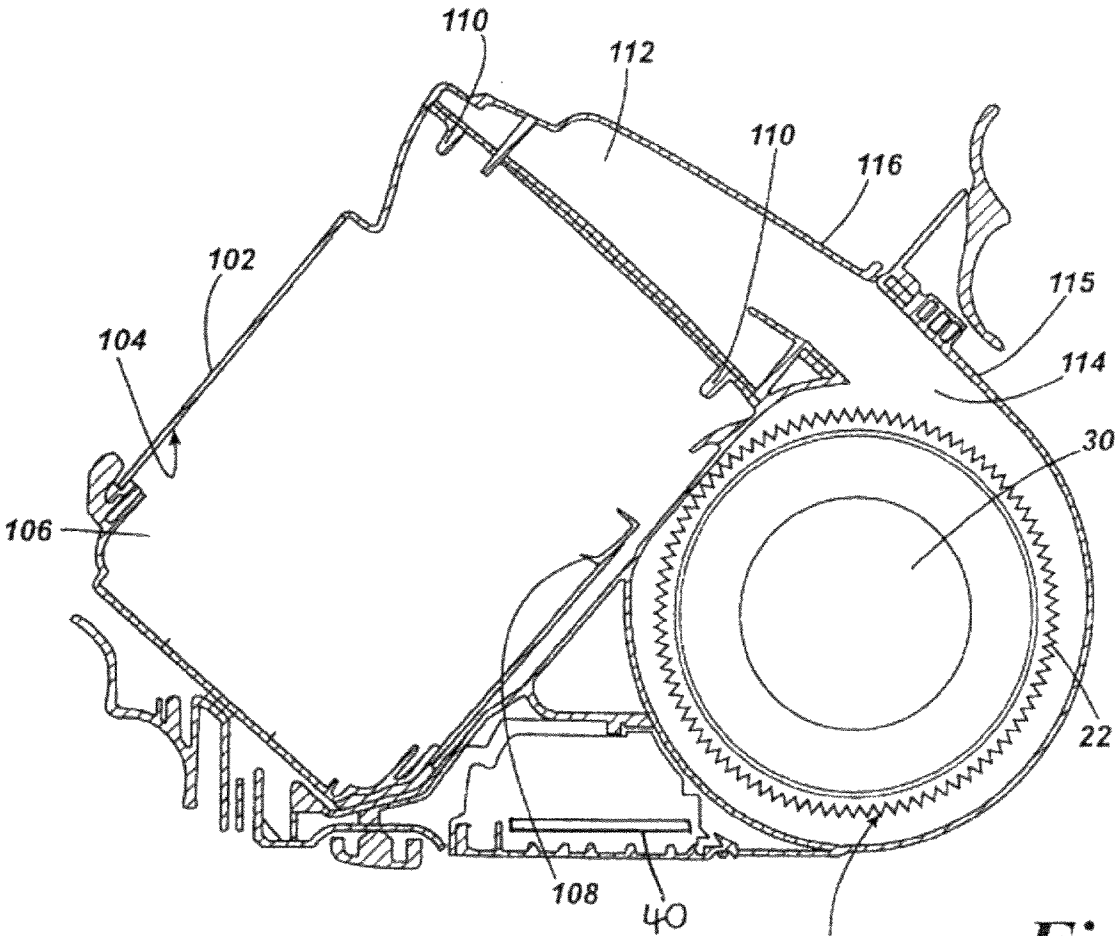
FIG. 3 is a side section taken along the line A-A of FIG. 2.

A vacuum cleaner according to the invention is shown in FIGS. 1, 2 and 3. The vacuum cleaner 10 has a main body 12 housing a motor and fan (shown as motor and fan unit 30) and to which a pair of wheels 14 is attached. The wheels 14 allow the main body 12 of the vacuum cleaner 10 to be maneuvered across a floor surface. In this example, the separating apparatus 18 takes the form of a cyclonic separator. However, other arrangements, for example, a pleated filter or a bag, may be used. The nature of the separating apparatus 18 is not material to the invention.

A dirty air inlet 16 is formed on the main body 12. A hose and wand assembly (not shown) can be connected to the dirty air inlet 16 in order to enable a user to clean a floor surface.

The interior of the cyclonic separating apparatus 100 is in communication with the dirty air inlet 16 through which a dirt-laden airflow enters the cyclonic separating apparatus 100. The cyclonic separating apparatus 100 can be removed from the main body 12 for emptying purposes.

The cyclonic separating apparatus 100 comprises a substantially cylindrical outer wall 102. The outer wall 102 defines part of a cyclonic separator system 104 and a collector 106. Dirt and dust is both separated by the cyclonic separator system 104 and collected in the collector 106 in this region. An inlet 108 is formed in the outer wall 102. The inlet 108 forms a communication path between the dirty air inlet 16 and the interior of the cyclonic separator 104. The air inlet 108 is arranged tangentially to the cyclonic separator 104 so that the incoming air is forced to follow a helical path around the interior of the outer wall 102.

The air outlets 110 of the cyclonic separator system 104 are in communication with an outlet 112. The outlet 112 provides an airflow path from the cyclonic separating apparatus 100 into other parts of the vacuum cleaner 10. Located downstream of the outlet 112 is pre-motor filter 20, the motor and fan unit 30 and a post-motor filter 40. The passageway 114 and outer wall 116 are arranged to form a scroll shaped inlet to the filter 20 and the pre-motor filter 20 is located in passageway 114, arranged to lie on the horizontal x axis of FIG. 2. The cross-sectional area of the passageway 114 between the wall 116 and the filter surface 22 decreases in the downstream direction.

Figure 4:
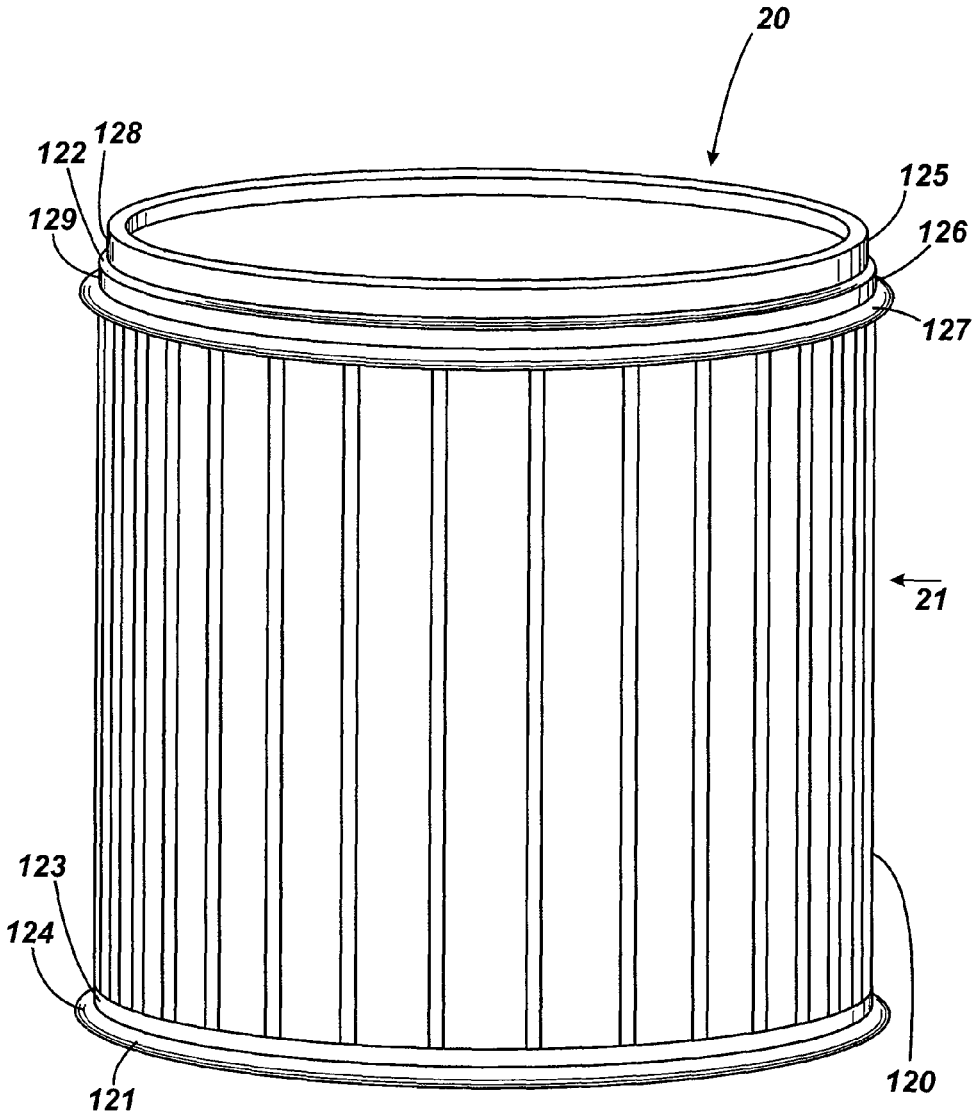
FIG. 4 is a perspective view of a filter assembly forming part of the vacuum cleaner of FIG. 1.
Figure 5:
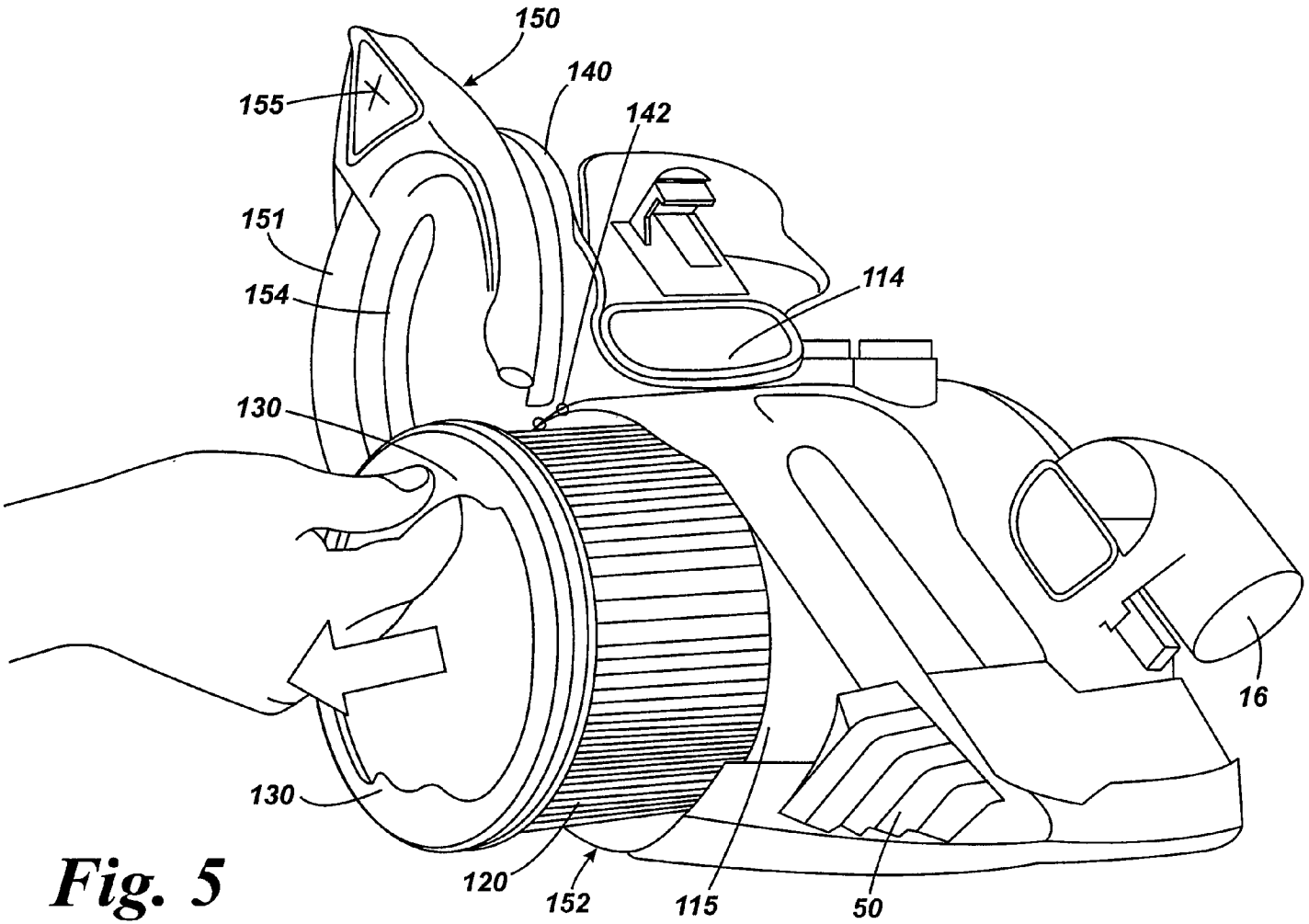
FIG. 5 is a perspective view of the vacuum cleaner of FIG. 1, showing the cyclonic separating apparatus removed from the cylinder vacuum cleaner of FIG. 1 and showing the removal of the filter assembly of FIG. 4.

Referring now to FIGS. 4 and 5, the pre-motor filter assembly 20 essentially comprises a cylindrical sleeve 21 of filter material 120 delimited by first 121 and second 122 rim portions. The rim portions 121, 122 are arranged to encapsulate the filter material 120. Rim 121 comprises a first annular ring 123 and rim edge 124. The annular ring 123 is arranged to overlap an area of the edge of the filter material 120 to clamp or fix the filter material in place. Rim edge 124 is provided to aid placement and location of the filter in the passageway 114 of the appliance. Rim 122 comprises second 125 and third 126 annular rings and a rim edge 127. Annular ring 126 has a diameter greater than annular rig 125. Rim edge 127 has a diameter greater than annular rig 126. Cylindrical outer walls 128 and 129 of respective annular rings 125, 126 are arranged to provide location and support for the filter assembly in the body of the appliance. The rim edge 127 is arranged to overlap an area of the edge of the filter material 120 to clamp or fix the filter material in place.

The rims 121 and 122 are manufactured from a plastics material of suitable hardness, durability and strength to be mounted securely in the appliance around the motor and fan unit 30. A suitable material from which the rims 121 and 122 can be manufactured is polyurethane with a hardness of between 20 and 90 Duro measured on the Shore A Rockwell scale.

In the preferred embodiment the filter material 120 is pleated. A pleated configuration, shown in section as a saw tooth arrangement in FIG. 3, provides a large surface area for filtration. Any suitable filter material, or combination of material layers may be used, such as electrostatic filter material, HEPA (High Efficiency Particulate Arrest) material, a non woven filter medium such as fleece or a mesh. The filter material or layers(s) are held together in a known manner by stitching or other sealing means.

A tab 130 or shaped portion may be provided on the filter assembly to assist with the removal of the filter assembly 20 from the passageway 114 in the main body 12 of the appliance 10.

Referring to FIG. 5, a shaped or recessed portion 115 comprising the passageway 114, is arranged to accommodate filter assembly 20. Portion 115 includes the accommodation around the motor and fan unit 30 in the main body 12. A side portion 150 of the of the main body 12 is arranged to move from a retracted position, proximate the main body 12 and motor unit 30, to an extended position away from the main body 12 and exposing an opening 152 to the recessed portion 115. The side portion 150 includes a door 151 maintained in an attached state to the main body 12 by a hinge 142. The door 151 includes a wheel 140 mounted on and around the outer surface of side portion 150 and a fastening means 155 arranged to engage with a corresponding fastening means on the main body 12 in order to secure the door 151 closed during use of the vacuum cleaner 10. In a preferred embodiment the fastening means 155 is easily accessible for a user, and comprises a quarter-turn screw that twists to release and can be operated with a simple tool such as the edge of a coin. The inner surface of the door 151 includes a shaped region adapted and arranged to abut the rim 122 of the filter assembly 20 in order to locate the filter assembly 20 correctly within the main body 12.

The features of the rim 122 and the inner surface of the door 151 or the side portion 150 can be used in conjunction with the vacuum cleaner 10 in order to prevent the user from inadvertently positioning the filter assembly 20 in the vacuum cleaner 10 in an incorrect position or orientation or attempting to operate the vacuum cleaner with the filter assembly 20 in an incorrect position. The rim 122 and surface are dimensioned and arranged such that they are able to co operate with a portion of the vacuum cleaner. For example the door 151 may be prevented from closing or a microswitch controlling the power to the motor may not be actuated unless the filter assembly is mounted in the vacuum cleaner correctly.

In use, the motor and fan unit 30 draws a flow of dirt-laden air through the hose and wand, into the dirty air inlet 16, through the inlet 108 and into the cyclonic separating apparatus 100.

Cleaned air then flows back through the cyclonic separator system 104, exits through the air outlets 110 and enters the outlet 112. The cleaned air then passes from the outlet 112 sequentially through the pre-motor filter 20, the motor and fan unit 30, and the post-motor filter 40 before being exhausted from the vacuum cleaner 10 through air vents 50 located on the outer surface of the vacuum cleaner 10.

When a cleaning operation is finished, the collector 106 of the cyclonic separating apparatus 100 may be full of dirt and dust, and require emptying. To do this, the user switches off the vacuum cleaner 10. The user releases the cyclonic separating apparatus 100 from the main body 12 by pressing a release button (not shown), removes the cyclonic separating apparatus 100 from the remainder of the vacuum cleaner 10 and places it over a suitable receptacle such as a dustbin. The user then presses a further release button (not shown) in order to release the catch 15. The dirt and dust collected in the collector(s) 106 can thus be emptied conveniently and efficiently.

When the cyclonic separating apparatus 100 has been emptied as described above, the user manually moves the closure member 15*a* back into the closed position shown in FIGS. 1 and 3. After an operation such as this emptying of the collector 106 of the cyclonic separating apparatus 100. The cyclonic separating apparatus 100 can be replaced on the main body 12 of the vacuum cleaner 10 (as shown in FIGS. 1 and 2) for further cleaning operations.

Through use, the filter assembly 20 and filter material 120 will become clogged with dust or dirt. Continued use would lead to a restriction in the airflow through the filter assembly 20. This causes a reduction in the filtration efficiency. In order to alleviate this, the filter assembly 20 must be replaced or washed. To do this, the user switches off the vacuum cleaner 10. In the preferred embodiment the filter material and assembly 20 are capable of being cleaned by washing. The filter assembly 20 is removed from the vacuum cleaner main body 12 through the door 151. The door is released from its secured, closed position by the release, by the user, of fastening 155. Once the user has obtained access to the recess 115 accommodating the filter assembly 20 the filter assembly is removed by the user gripping the tabs 130 and pulling the tab 130 outwardly from the housing, towards the user along axis X-X of FIG. 2. In this way, the user does not have to handle the clogged filter assembly 20 directly. This makes replacing or cleaning the filter assembly 20 a more hygienic task. The filter assembly 20 is washed by rinsing under a household tap in a known manner and allowed to dry. The filter assembly 10 is then re-inserted into the main body 12 and housing recess 115 of the appliance or vacuum cleaner 10, and operation can continue.

The invention is not limited to the detailed description given above. Variations will be apparent to the person skilled in the art. For example, a part of the cyclonic separating apparatus other than the wheel may comprise a door and may be movable for filter cleaning purposes. For example, the side or top of the cyclonic separating apparatus may be movable (or openable). Other opening arrangements for the door member may be used; for example, sliding, retracting or rotating door members. Other forms, arrangements and locations of fastener members for a door may be used, for example screws, bolts or resealable or glue fastenings.

The invention has been described in relation to a pre-motor filter, but could of course be implemented for a post-motor filter. In appliances incorporating a pre-motor filter and a post-motor filter, both filters could be removable through a side of the appliance. The filters could be removable through the same side of the appliance, or different sides. In the case of the filters being removable through the same side of the appliance, there may be provided a common door for the filters, or separate doors for each filter.

Additionally, the filter assembly need not be cylindrical. Other arrangements, for example, oval, annular, square, rectangular or cuboid shapes could be used. Other filter materials and construction may be used, for example a mesh, non-pleated material, electrostatic layers. Other materials may be used for the assembly e.g. plastics, PE etc.

The filter assembly may be located in the main body using other means, for example by a push or friction fit. The cleaning appliance need not be a cylinder vacuum cleaner. The invention is applicable to other types of vacuum cleaner, for example, upright machines, stick-vacuums or hand-held cleaners. Further, the present invention is applicable to other types of cleaning appliances, for example, a wet and dry machine or a carpet shampooer.

The invention claimed is:

1. A cleaning appliance comprising a main body, the main body including a motor and fan unit for generating an airflow, a separating apparatus for separating dirt and dust from the airflow and a cylindrical filter extending fully around the motor and fan unit, wherein the filter is removable through a side of the appliance, the appliance further comprising a passageway for receiving the filter, the passageway forming a scroll inlet to the filter.

2. The cleaning appliance of claim 1, wherein the filter is removable through a wheel arranged at the side of the appliance.

3. The cleaning appliance of claim 2, wherein a portion of the wheel is moveable between sealed and open positions.

4. The cleaning appliance of claim 2 or 3, wherein the wheel comprises a fastening device configured to retain and release the opening portion.

5. The cleaning appliance of claim 1 or 2, wherein the passageway comprises a wall and wherein the cross-sectional area of the passageway between the wall and the filter surface decreases in the downstream direction.

6. The cleaning appliance of claim 1 or 2, wherein the filter is located downstream of the separating apparatus and upstream of the motor and fan unit.

7. The cleaning appliance of claim 1 or 2, wherein the filter is located downstream of the motor and fan unit.

8. A vacuum cleaner comprising the cleaning appliance of claim 1 or 2.

9. A vacuum cleaner comprising the cleaning appliance of claim 5.

* * * * *